US007157893B2

(12) United States Patent
Lee

(10) Patent No.: US 7,157,893 B2
(45) Date of Patent: Jan. 2, 2007

(54) TEMPERATURE INDEPENDENT REFERENCE VOLTAGE GENERATOR

(75) Inventor: Jong-Chern Lee, Ichon-shi (KR)

(73) Assignee: Hynix Semiconductor Inc., Ichon-shi (KR)

( * ) Notice: Subject to any disclaimer, the term of this patent is extended or adjusted under 35 U.S.C. 154(b) by 254 days.

(21) Appl. No.: 10/878,568

(22) Filed: Jun. 29, 2004

(65) Prior Publication Data

US 2005/0093530 A1 May 5, 2005

(30) Foreign Application Priority Data

Oct. 31, 2003 (KR) ..... 10-2003-0076798

(51) Int. Cl.
*G05F 3/16* (2006.01)

(52) U.S. Cl. ..... 323/314; 323/315; 323/907

(58) Field of Classification Search ..... 323/313, 323/314, 315, 901, 907
See application file for complete search history.

(56) References Cited

U.S. PATENT DOCUMENTS 4,352,056 A * 9/1982 Cave et al. ..... 323/314
4,362,985 A * 12/1982 Tsuchiya ..... 323/314
4,433,283 A * 2/1984 Gersbach ..... 323/314
4,634,959 A * 1/1987 Boeckmann ..... 323/313
5,084,665 A * 1/1992 Dixon et al. ..... 323/281
5,434,533 A * 7/1995 Furutani ..... 327/538
5,841,270 A * 11/1998 Do et al. ..... 323/314
6,111,397 A * 8/2000 Leung ..... 323/315
6,528,979 B1 * 3/2003 Kimura ..... 323/313

FOREIGN PATENT DOCUMENTS

KR 1019960000602 1/1996

* cited by examiner

*Primary Examiner*—Jeffrey Sterrett
(74) *Attorney, Agent, or Firm*—Mayer, Brown, Rowe & Maw LLP

(57) ABSTRACT

There is provided a reference voltage generator that generates a constant reference voltage regardless of a change in temperature. The reference voltage generator includes a temperature-compensated current generating part for reducing a supply current provided to an output terminal in response to an increase of temperature, and a diode for receiving the supply current through the output terminal.

14 Claims, 8 Drawing Sheets

$3 * I2 = I1 = 4 * It$

TEMPERATURE INDEPENDENT REFERENCE VOLTAGE GENERATOR

FIELD OF THE INVENTION

The present invention relates to a semiconductor integrated circuit; and, more particularly, to a reference voltage generator for generating a constant reference voltage regardless of a change in temperature.

DESCRIPTION OF RELATED ART

Generally, reference voltage generators are used in an analog-to-digital converter (ADC), a digital-to-analog converter (DAC), a low-voltage DRAM, and so on, in order to obtain a constant reference voltage regardless of a change in temperature or power supply voltage.

In case when an accurate reference voltage is required, a reference voltage generator using a bandgap of silicon is widely used. At this time, in order to generate a constant reference voltage regardless of a change in temperature, a voltage having a negative temperature coefficient and a voltage having a positive temperature coefficient are generated and then are summed to thereby make a temperature coefficient zero. A voltage difference between a base and an emitter of a transistor is used as a negative coefficient voltage. A voltage difference between a base and an emitter of a different transistor, which is proportional to an absolute temperature, is used as a positive coefficient voltage.

FIG. 1 is a circuit diagram of a conventional reference voltage generator.

Referring to FIG. 1, the conventional reference voltage generator includes a current generation block 10 for providing a supply current $I_t$, a reference voltage output block 20 for outputting a first reference voltage $V_{out}$ corresponding to the supply current $I_t$, and a level shifter 30 for shifting a voltage level of the first reference voltage $V_{out}$ to output a second reference voltage $V_{out2}$.

The current generation block 10 includes a current mirror unit 11 for supplying a mirrored current, a temperature sensing unit 12 for increasing a mirrored reference current outputted from the current mirror unit 11 according to an increase of temperature, and a current supplying unit 13 for providing the supply current It in synchronization with a variation amount of the current mirrored from the current mirror unit 11.

The current mirror unit 11 includes: a MOS transistor MP0 having one terminal connected to a power supply terminal VDD; a MOS transistor MP2 having one terminal connected to the power supply terminal VDD and a gate connected to a gate of the MOS transistor MP0; a MOS transistor MP1 having one terminal connected to the other terminal of the MP0; a MOS transistor MP3 having one terminal connected to the other terminal of the MOS transistor MP2, a gate connected to a gate of the MOS transistor MP1, and the other terminal connected to the gates of the MOS transistors MP0 and MP1; a resistor R3 having one terminal connected to the other terminal of the MOS transistor MP3 and the other terminal connected to the gates of the MOS transistors MP1 and MP3; a MOS transistor MN0 having a gate connected to the other terminal of the MOS transistor MP1; and a MOS transistor MN1 having a gate connected to the gate of the MOS transistor MN0 and one terminal connected to one terminal of a resistor R2.

The temperature sensing unit 12 includes: a bipolar junction transistor PNP0 for connecting the other terminal of the MOS transistor MN0 to a ground terminal VSS, in which the bipolar junction transistor PNP0 has a base connected to the ground terminal VSS; the resistor R2 having one terminal connected to the other terminal of the MOS transistor MN1; and a bipolar junction transistor PNP1 for connecting the other terminal of the resistor R2 to the ground terminal VSS, in which the bipolar junction transistor PNP1 has a base connected to the base of the bipolar junction transistor PNP0.

The current supplying unit 13 includes: a MOS transistor MP4 having one terminal connected to the power supply terminal VDD and a gate connected to the gate of the MOS transistor MP2; and a MOS transistor MP5 having one terminal connected to the other terminal of the MOS transistor MP4 and a gate connected to the gate of the MOS transistor MP3.

The reference voltage output unit 20 includes: a resistor R1 having one terminal receiving the supply current $I_t$; and a bipolar junction transistor PNP2 for connecting the other terminal of the resistor R1 and the ground terminal, in which the bipolar junction transistor PNP2 has a base connected to the base of the bipolar junction transistor PNP0.

Hereinafter, an operation of the conventional reference voltage generator will be described with reference to FIG. 1.

The reference current I1 flowing through the resistors R3 and R2 is proportional to area ratio of the bipolar junction transistors PNP0 and PNP1 and the threshold voltage Vth of the transistors, like an equation 1 below.

$$I1=Vth\times In(n)/R2 \quad \text{(Eq. 1)}$$

where, n denotes an area ratio of the bipolar junction transistors PNP0 and PNP1, and Vth denotes a threshold voltage of the bipolar junction transistors PNP0 and PNP1.

If the temperature increases, the reference current I1 increases in proportion to the threshold voltage Vth.

The current supplying unit 13 flows the supply current It provided by mirroring the reference current I1. If the area ratio of the MOS transistors MP4 and MP2 are equal, the supply current It flows with the same amount of the reference current I1.

Therefore, a final reference voltage Vout is outputted like an equation 2 below.

$$V\text{out}=I1\times R1+Vbe \quad \text{(Eq. 2)}$$

where, Vbe denotes a base-emitter voltage level of the bipolar junction transistor PNP2. The voltage Vbe decreases as the temperature increases.

Accordingly, the reference voltage Vout determined by the equation 2 has a characteristic that it maintains a constant level according to the temperature by a sum of the reference current I1 and the voltage Vbe. Here, as the temperature increases, the reference current I1 increases and the voltage Vbe decreases.

However, the reference voltage generator of FIG. 1 can output a constant reference voltage Vout regardless of the change in temperature when the reference voltage Vout is about 1.25 V.

This is because a temperature compensation effect disappears when the output level of the reference voltage Vout is higher or lower than 1.25 V, so that there occurs a problem that the output can change depending on the temperature.

If the voltage level of the reference voltage Vout is to be 1.25V, the MOS transistors MP4 and MP5 must be stably turned on. For this reason, the power supply voltage VDD must be at least Vout=2×Vth. In other words, the reference voltage generator of FIG. 1 can operate when the power supply voltage VDD is at least 2.5 V.

Recently, with the tendency of low power consumption, the semiconductor device requires to operate at a low voltage of 1.8 V or less. The reference voltage generator of FIG. 1 cannot be applied to the semiconductor device that operates at a low voltage of 1.8 V or less.

Also, a voltage level of the reference voltage Vout that the semiconductor device used internally is lowered. As shown in FIG. 1, the conventional reference voltage generator must additionally use a level shifter 30 for shifting a voltage level of the reference voltage Vout. Therefore, there occur problems that increase additional power consumption and circuit area.

SUMMARY OF THE INVENTION

It is, therefore, an object of the present invention to provide a reference voltage generator, which generates a constant reference voltage regardless of a change in temperature and is operable at a low voltage level.

In an aspect of the present invention, there is provided a reference voltage generator, which includes: a temperature-compensated current generating part for reducing a supply current provided to an output terminal in response to an increase of temperature; and a diode for receiving the supply current through the output terminal, whereby a constant reference voltage is generated regardless of a change in temperature.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Hereinafter, the present invention will be described in detail with reference to the accompanying drawings.

Figure 2:
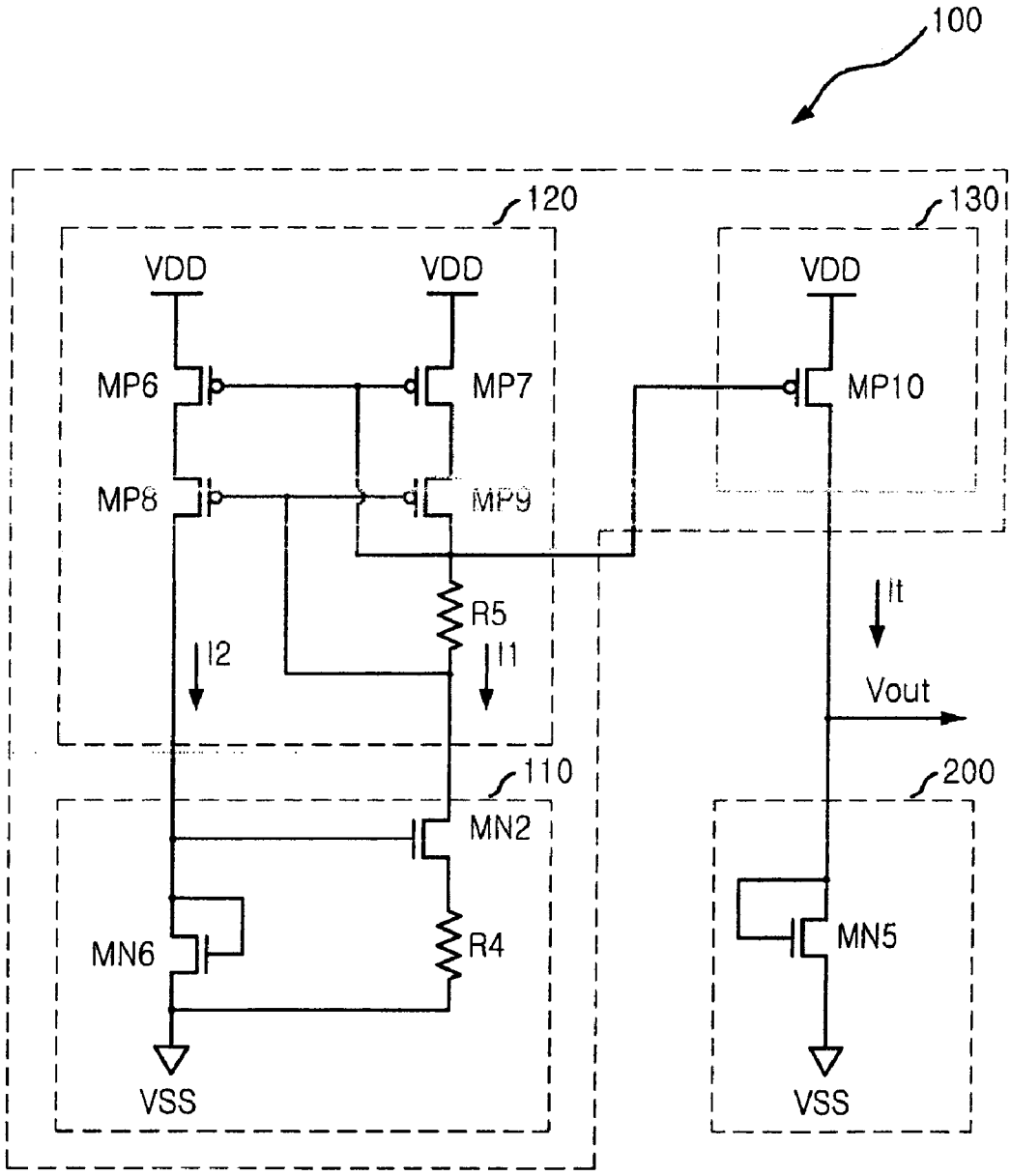
FIG. 2 is a circuit diagram of a reference voltage generator in accordance with a first embodiment of the present invention.

FIG. 2 is a circuit diagram of a reference voltage generator in accordance with a preferred embodiment of the present invention.

Referring to FIG. 2, a reference voltage generator of the present invention includes a temperature-compensated current generating part 100 for reducing a supply current It provided to an output terminal in response to an increase of temperature, and a diode 200 for receiving the supply current It through the output terminal Vout. The reference voltage generator constructed as above outputs a constant reference voltage Vout regardless of a change in temperature. The diode 200 is configured with a NMOS transistor MN5 having a gate connected to one terminal thereof. The diode 200 receives the supply current It through one terminal and transfers it to a ground terminal VSS connected to the other terminal.

The temperature-compensated current generating part 100 includes: a temperature sensing unit 110 for detecting an increase of temperature and reducing an output impedance; a current mirror unit 120 for supplying a first reference current I1 corresponding to an output impedance of the temperature sensing unit 110 and a second reference current I2 corresponding to a mirrored first reference voltage; and a current supplying unit 130 for supplying the supply current It to the diode 200 in synchronization with a variation of the reference currents I1 and I2.

The temperature sensing unit 110 includes: a diode-connected MOS transistor MN6 for receiving the second reference current I2 through one terminal and transferring it to the ground terminal VSS through the other terminal; a MOS transistor MN2 having a gate connected to one terminal of the MOS transistor MN6 and one terminal receiving the first reference current I1; and a temperature-sensing resistor R4 connected between the other terminal of the MOS transistor MN2 and the ground terminal VSS.

The current supplying unit 130 includes a MOS transistor MP10 having one terminal connected to the power supply terminal VDD, a gate connected to a gate of a MOS transistor MP7, and the other terminal outputting the supply current It to the diode 200.

The current mirror unit 120 includes: a MOS transistor MP6 having one terminal connected to the power supply terminal VDD; a MOS transistor MP7 having one terminal connected to the power supply terminal VDD and a gate connected to a gate of the MOS transistor MP6; a MOS transistor MP8 having one terminal connected to the other terminal of the MOS transistor MP6; a MOS transistor MP9 having one terminal connected to the other terminal of the MOS transistor MP7, a gate connected to a gate of the MOS transistor MP8, and the other terminal connected to the gates of the MOS transistors MP6 and MP7; and a resistor R5 having one terminal connected to the other terminal of the MOS transistor MP9 and the other terminal connected to the gates of the MOS transistors MP8 and MP9.

Figure 3:
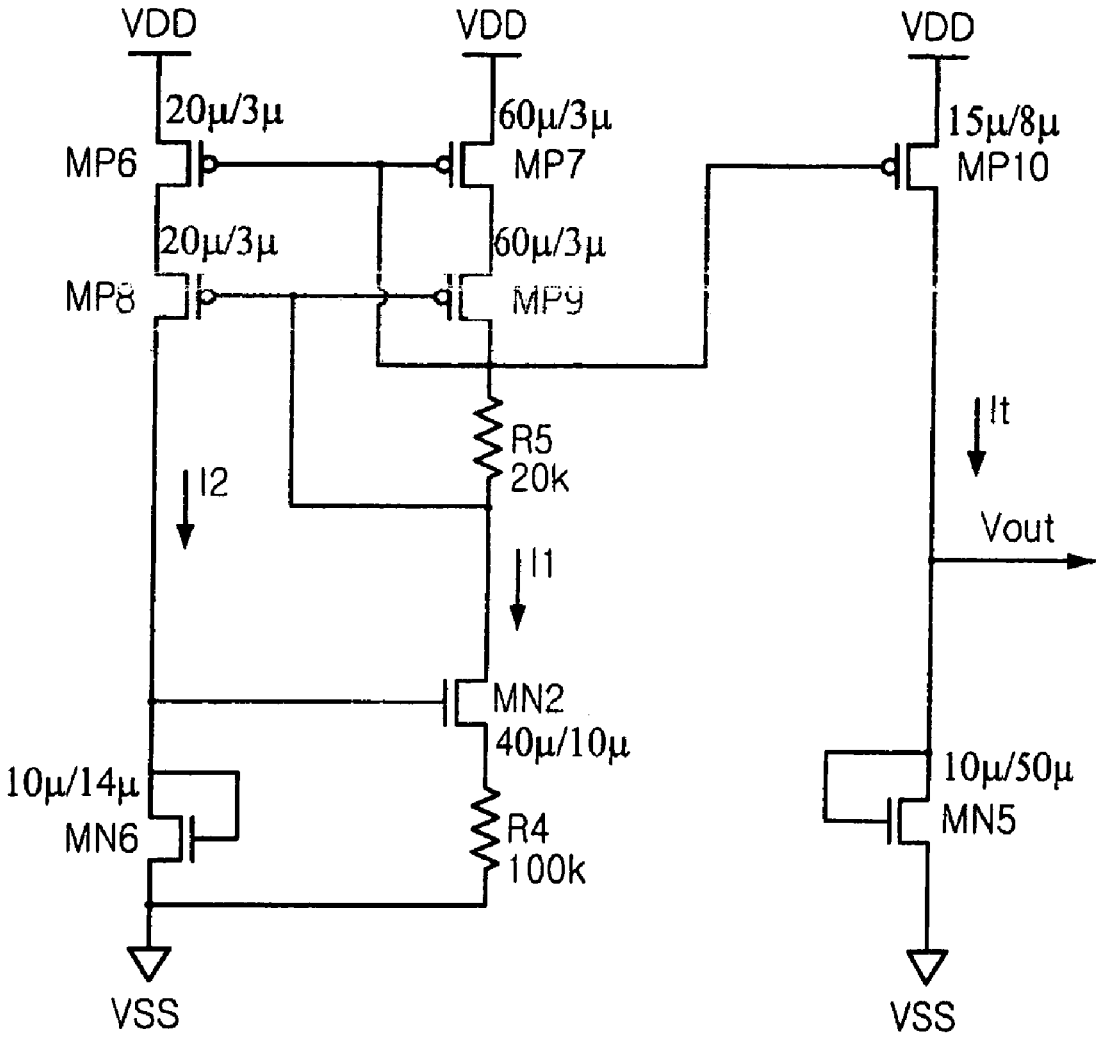
FIG. 3 is a circuit diagram illustrating an actual implementation of the reference voltage generator shown in FIG. 2.

FIG. 3 is circuit diagram illustrating an actual implementation of the reference voltage generator shown in FIG. 2. Here, a current ratio transferred through the MOS transistor MP7:the MOS transistor MP6:the MOS transistor MP10 of the temperature-compensated current generating part 100 is 1:1/3:1/4. This is a case when the reference voltage level is about 0.8 V. In some cases, the current ratio can be adjusted.

Figure 1:
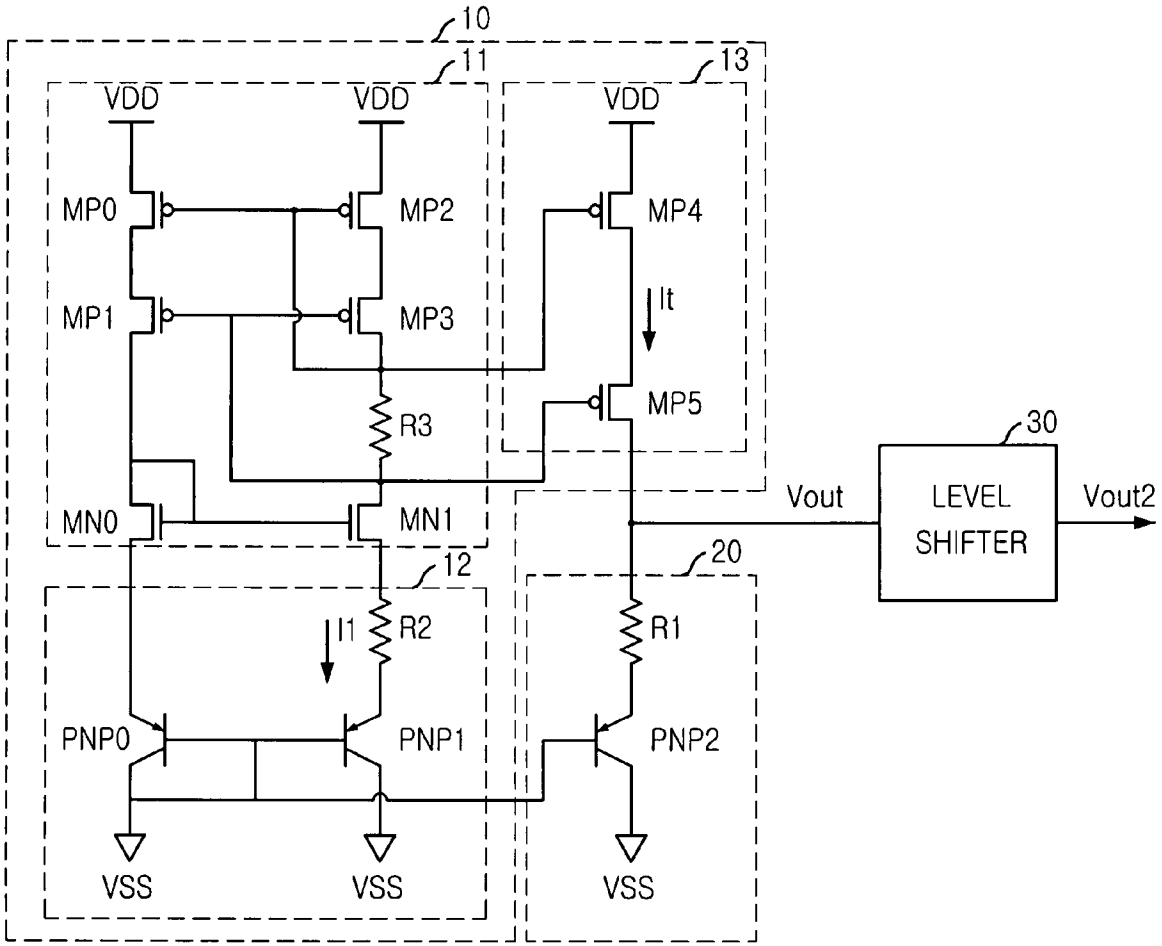
FIG. 1 (PRIOR ART)
FIG. 1 is a circuit diagram of a conventional reference voltage generator.
Figure 4:
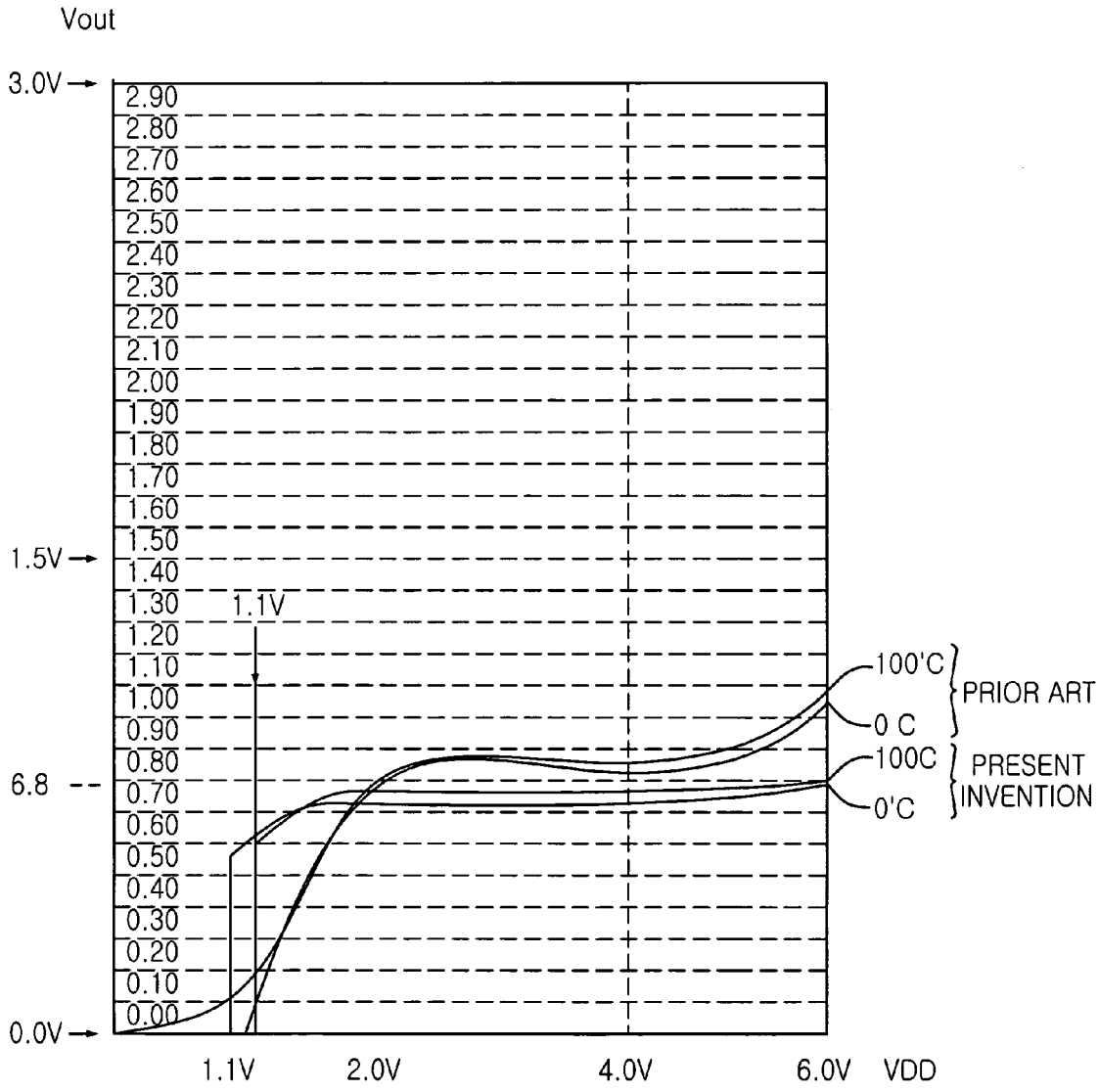
FIG. 4 is a simulation waveform of the reference voltage generators shown in FIGS. 1 and 2.

FIG. 4 is a simulation waveform of the reference voltage generators shown in FIGS. 1 and 2. Hereinafter, an operation of the reference voltage generator in accordance with the present invention will be described with reference to FIGS. 2 to 4.

The MOS transistors MP6 and MP7 of the current mirror unit 120 configure one current mirror and provide the second reference current I2 to the diode-connected MOS transistor MN6. The MOS transistors MP8 and MP9 configure one current mirror and provide the first reference current I1 to the MOS transistor MN2. Here, the resistor R4 acts as a resistor for stabilizing an operation point of the current mirrors of the current mirror unit 120.

The MOS transistor MP10 of the current supplying unit 130 supplies the supply current It to the diode 200. Here, the supply current It is a current that is given by mirroring the first reference current I1.

Although the first and second reference currents I1 and I2 and the supply current It are configured to flow in a ratio of 1, 1/3 and 1/4, the current ratio can be changed depending on the applied conditions.

The first and second reference currents I1 and I2 and the supply current It are determined by an equation 3 below.

$$I1=\beta_1 Vt^2 e^{(Vgs2-VT)}/nVt,$$

$$I2=\beta_2 Vt^2 e^{(Vgs6-VT)}/nVt$$

$$It=\beta_3 Vt^2 e^{(Vgs5-VT)}/nVt \quad \text{(Eq. 3)}$$

where, Vgs2, Vgs6 and Vgs5 denote gate-drain voltages of the MOS transistor MN2, MN6 and MN5, respectively. Here, $\beta=WCox\mu/L$, $Vt=kT/q$, and $VT=kt/q\times(\ln(n_0/n_t)-Qd/Cox)$.

Since the first and second reference currents I1 and I2 and the supply current It are configured to flow in a ratio of 1, 1/3 and 1/4, the respective currents are determined by an equation 4 below.

$$It=I1/4,\ I2=I1/3 \quad \text{(Eq. 4)}$$

Meanwhile, a voltage applied to the MOS transistor MN5 of the temperature sensing unit 110 is given by an equation 5 below.

$$Vgs1=Vgs2+I1\times R4 \quad \text{(Eq. 5)}$$

Using the above equations 3 to 5, the currents I1, I2 and It are expressed as an equation 6 below.

$$I1=nVt/R\times ln(\beta_1/3\ \beta_2),\ I2=nVt/3R\times ln(\beta_1/3\ \beta_2),\ I3=nVt/4R\times ln(\beta_1/3\ \beta_2) \quad \text{(Eq. 6)}$$

Meanwhile, a reference voltage Vout applied to the MOS transistor MN5 is expressed as an equation 7 below.

$$Vout = Vgs5 = nVt\times\ln(I3/\beta_3\times Vt^2)+V_T \quad \text{(Eq. 7)}$$

$$= nVt\times\ln(n/(4\beta_3\times Vt\times R_4)\times\ln(\beta_1/3\beta_2))+V_T$$

As a result, the component VT has a characteristic that its value decreases if the temperature increases, and the component Vt has a characteristic that its value increases if the temperature increases. Therefore, even if the temperature increases or decreases, a variation of the output Vout according to the temperature is slight because the temperature increase and decrease parameters are balanced.

In accordance with the present invention, the reference voltage Vout is the voltage applied between both terminals of the diode-connected MOS transistor MN5 and is in a range of about 0.7 V to about 0.8 V.

In FIG. 4, there is shown a simulation result of the reference voltage generators depicted in FIGS. 1 and 3. FIG. 4 is a simulation result in a range of 0° and 100° in the reference voltage generators according to the prior art and the present invention. The reference voltage generator according to the prior art shifts the reference voltage Vout1 of about 1.25 V by about 0.8 V through the level shifter.

The reference voltage generator according to the prior art stably outputs the reference voltage in the temperatures of 0° C. and 100° C. when the power supply voltage VDD is about 2.0 V or more. On the other hand, the reference voltage generator according to the present invention stably outputs the reference voltage when the power supply voltage is about 1.1 V or more.

Also, when the power supply voltage is a high voltage of more than 5 V, the reference voltage generator according to the present invention can stably output the reference voltage of about 0.8 V.

As described above, the reference voltage generator according to the present invention outputs the reference voltage of 0.6 V to 0.8 V. Therefore, a sufficient operation margin can be secured even at a low operation voltage. Thus, it can be applied to semiconductor devices operating at a low voltage.

The reference voltage generator according to the present invention does not require the additional level shifter when the low reference voltage of about 0.8 V is necessary. Thus, a circuit area does not additionally increases, so that the power consumption does not increase.

Figure 5:
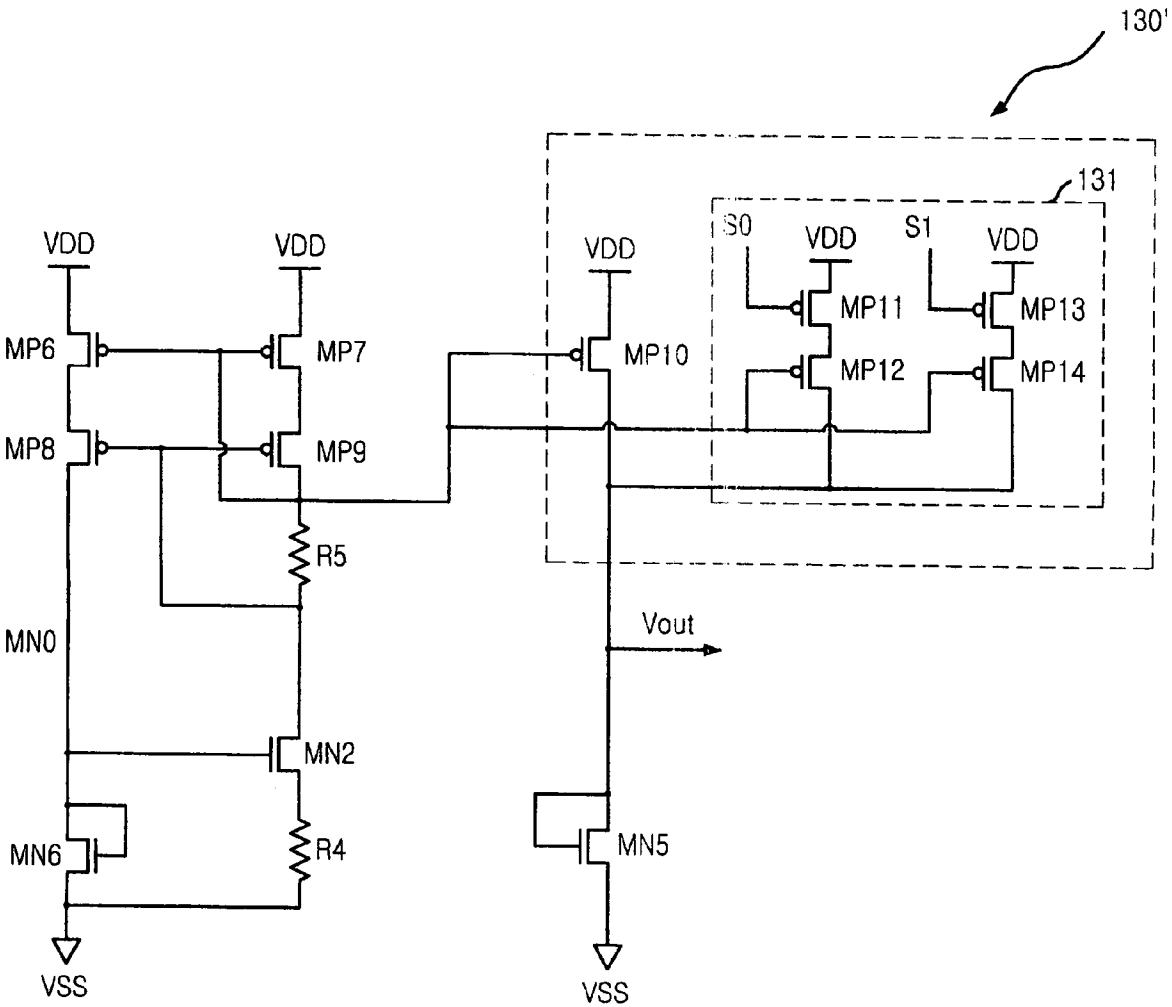
FIG. 5 is a circuit diagram of a reference voltage generator in accordance with a second embodiment of the present invention.

FIG. 5 is a circuit diagram of a reference voltage generator in accordance with a second embodiment of the present invention. A difference from the reference voltage generator of FIG. 2 is a current supplying unit.

Referring to FIG. 5, a current supplying unit 130' includes a MOS transistor MP10 and a count adjusting unit 131. The current adjusting unit includes: a MOS transistor MP11 having one terminal connected to a power supply terminal VDD and a gate receiving a first selection signal S0; a MOS transistor MP12 configured to connect the other terminal of the MOS transistor MP11 and the other terminal of the MOS transistor MP10, in which a gate of the MOS transistor MP12 is connected to a gate of the MOS transistor MP10; a MOS transistor MP13 having one terminal connected to the power supply voltage VDD and a gate receiving a second selection signal S1; and a MOS transistor MP14 configured to connect the other terminal of the MOS transistor MP13 and the other terminal of the MOS transistor MP10, in which a gate of the MOS transistor MP14 is connected to the gate of the MOS transistor MP10.

The current supplying unit 130' of FIG. 5 can adjust an amount of the supply current It in response to the selection signals S0 and S1. For example, if both of the selection signals S0 and S1 are activated, an amount of the supply current is determined by the MOS transistors MP12, MP14 and MP10. If the selection signal S0 is activated, an amount of the supply current is determined by the MOS transistors MP12 and MP10.

Figure 6:
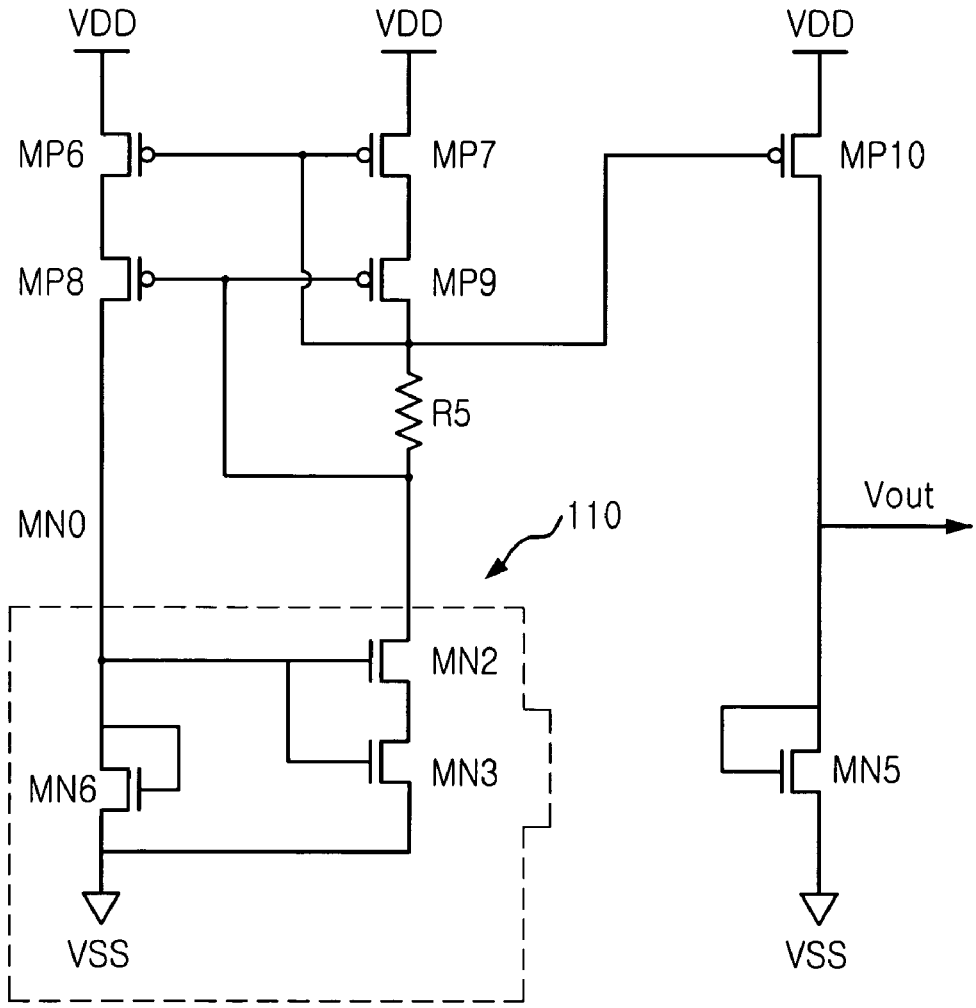
FIG. 6 is a circuit diagram of a reference voltage generator in accordance with a third embodiment of the present invention.

FIG. 6 is a circuit diagram of a reference voltage generator in accordance with a third embodiment of the present invention. A reference voltage generator of FIG. 6 uses a turn-on resistance of a MOS transistor MN3, instead of the resistor R4 provided at the temperature sensing unit in the reference voltage generator of FIG. 2. Since an overall operation of the reference voltage generator shown in FIG. 6 is identical to that of the reference voltage generator shown in FIG. 2, its description will be omitted.

Figure 7:
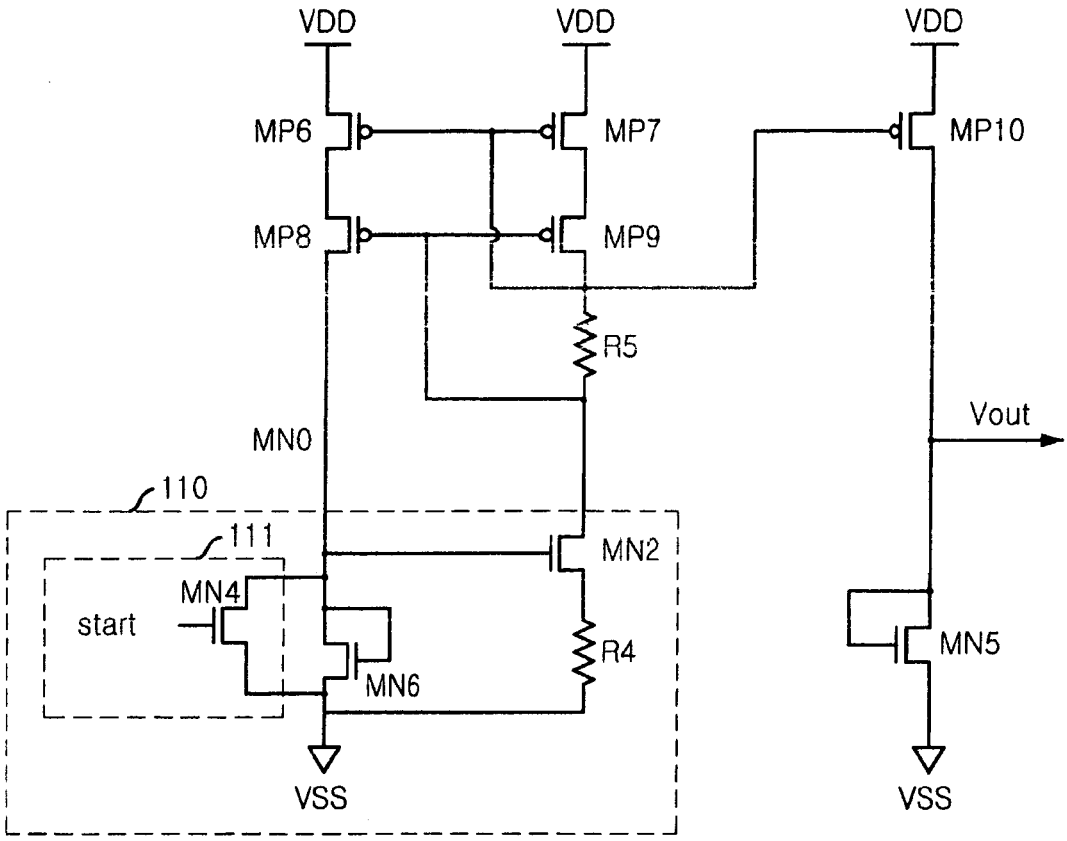
FIG. 7 is a circuit diagram of a reference voltage generator in accordance with a fourth embodiment of the present invention.

FIG. 7 is a circuit diagram of a reference voltage generator in accordance with a fourth embodiment of the present invention. A reference voltage generator of FIG. 7 further includes a MOS transistor MN4 for controlling an enabling of the temperature sensing unit 110 in the reference voltage generator of FIG. 2.

If a startup signal applied to the gate of the MOS transistor MN4 is in a logic high level, the MOS transistor MN4 is turned on and the MOS transistor MN2 is turned off, such that the temperature sensing unit 110 does not operate. If the startup signal is in a logic low level, the MOS transistor MN4 is turned off and the MOS transistor MN2 is turned on, such that the temperature sensing unit 110 operates.

Figure 8:
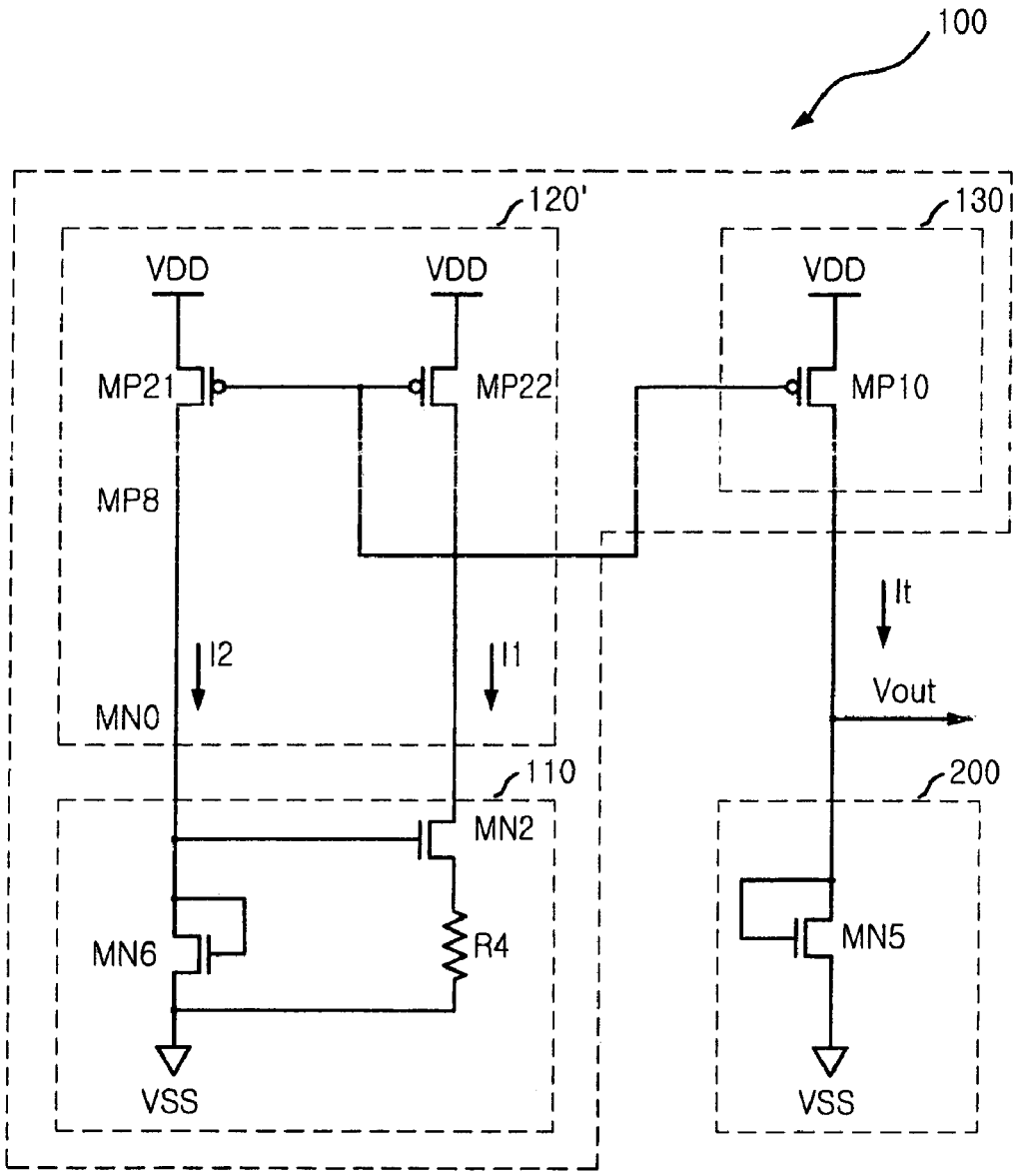
FIG. 8 is a circuit diagram of a reference voltage generator in accordance with a fifth embodiment of the present invention.

FIG. 8 is a circuit diagram of a reference voltage generator in accordance with a fifth embodiment of the present invention. A reference voltage generator of FIG. 8 is configured with a more simplified current mirror unit.

Referring to FIG. 8, a reference voltage current mirror unit 120' of the present invention includes: a MOS transistor MP21 having one terminal connected to a power supply terminal VDD and the other terminal supplying the second reference voltage I2; and a diode-connected MOS transistor MP22 having one terminal connected to the power supply terminal VDD, the other terminal supplying the first reference current I1, and a gate connected to a gate of the MOS transistor MP21, thereby forming a current mirror.

The reference voltage generator of FIG. 8 has the same structure as the reference voltage generator of FIG. 2, except for the current mirror unit 120'. Since the operation of generating the reference voltage is also identical to that of the reference voltage generator shown in FIG. 2, its description will be omitted.

Also, the additional structures of FIGS. 4 to 6 can be applied to the reference voltage generator of FIG. 8. For example, the resistor R4 can be replaced with the MOS transistor MN3 of FIG. 6. The reference voltage generator of FIG. 8 can further include the MOS transistor MN4 of FIG. 7, which receives the startup signal and enables or disables the temperature sensing unit 110. Further, the current supplying unit 130' of FIG. 5 can be applied to the reference voltage generator of FIG. 8.

In accordance with the present invention, the reference voltage generator that generates a constant voltage regardless of a change in temperature can be driven at a lower voltage level compared with the prior art, thereby reducing the power consumption. Also, the reference voltage generator in accordance with present invention does not require any additional level shifter in order for the lower voltage operation. Therefore, if the present invention is applied to the semiconductor devices operating at a low voltage, an area of an integrated circuit can be reduced.

The present application contains subject matter related to Korean patent application No. 2003-76798, filed in the Korean Patent Office on Oct. 31, 2003, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. An apparatus for generating a reference voltage, comprising:

a temperature-compensated current generating part for reducing a supply current provided to an output terminal in response to an increase of temperature, wherein the reference voltage is outputted through the output terminal; and a diode for receiving the supply current through the output terminal, whereby a constant reference voltage is generated regardless of a change in temperature, wherein the temperature-compensated current generating part includes:

a temperature sensing unit for detecting the increase of temperature and reducing an output impedance:

a unit for supplying a first reference current corresponding to the output impedance of the temperature sensing unit and a second reference current corresponding to a mirrored first reference voltage;

a current supplying unit for supplying the supply current to the diode in synchronization with a variation of the first and second reference currents; and a unit for adjusting an amount of the supply current in response to selection signals.

2. The apparatus as recited in claim 1, wherein the diode is configured with a MOS transistor.

3. The apparatus as recited in claim 1, wherein the diode is an NMOS transistor having one terminal receiving the supply current and the other terminal transferring the supply current to a ground terminal, a gate of the NMOS transistor being connected to the one terminal.

4. The apparatus as recited in claim 1, wherein the temperature sensing unit includes:

a diode-connected first MOS transistor for receiving the second reference current through one terminal and transferring the second reference current to a ground terminal through the other terminal;

a second MOS transistor having a gate connected to one terminal of the first MOS transistor and one terminal receiving the first reference current; and a temperature-sensing resistor connected between the other terminal of the second MOS transistor and the ground terminal.

5. The apparatus as recited in claim 4, wherein the temperature sensing unit further includes a third MOS transistor connected in parallel with the first MOS transistor, the third MOS transistor having a gate receiving a startup signal.

6. The apparatus as recited in claim 1, wherein the temperature sensing unit includes:

a diode-connected first MOS transistor having one terminal receiving the second reference current and the other terminal transferring the second reference current to a ground terminal;

a second MOS transistor having a gate connected to the one terminal of the first MOS transistor, the first reference current being inputted to the one terminal of the second MOS transistor; and a third MOS transistor connected between the other terminal of the second MOS transistor and the ground terminal, a gate of the third MOS transistor being connected to a gate of the second MOS transistor.

7. The apparatus as recited in claim 1, wherein the unit for supplying a first reference current includes:

a first MOS transistor having one terminal connected to a power supply terminal and the other terminal transferring the second reference current; and a diode-connected second MOS transistor having one terminal connected to the power supply terminal, the other terminal transferring the first reference current, and a gate connected to a gate of the first MOS transistor, thereby forming a current mirror.

8. The apparatus as recited in claim 7, wherein the current supplying unit includes a third MOS transistor having one terminal connected to the power supply terminal, a gate connected to the gate of the first MOS transistor, and the other terminal transferring the supply current.

9. The apparatus as recited in claim 8, wherein a current ratio transferred through the first MOS transistor, the second MOS transistor, and the third MOS transistor of the temperature-compensated current generating part is 1/3:1:1/4.

10. The apparatus as recited in claim 8, wherein the unit for adjusting the amount of the supply current includes:

a fourth MOS transistor having one terminal connected to the power supply terminal and a gate receiving a first selection signal of the selection signals;

a fifth MOS transistor configured to connect the other terminal of the fourth MOS transistor and the other terminal of the third MOS transistor, a gate of the fifth MOS transistor being connected to the gate of the third MOS transistor;

a sixth MOS transistor having one terminal connected to the power supply terminal and a gate receiving a second selection signal of the selection signals; and a seventh MOS transistor configured to connect the other terminal of the sixth MOS transistor and the other terminal of the third MOS transistor, a gate of the seventh MOS transistor being connected to the gate of the third MOS transistor.

11. The apparatus as recited in claim 1, wherein the unit for supplying a first reference current includes:

a first MOS transistor having one terminal connected to a power supply terminal;

a second MOS transistor having one terminal connected to the power supply terminal and a gate connected to a gate of the first MOS transistor;

a third MOS transistor having one terminal connected to the other terminal of the first MOS transistor;

a fourth MOS transistor having one terminal connected to the other terminal of the second MOS transistor, a gate connected to a gate of the third MOS transistor, and the other terminal connected to the gates of the first and second MOS transistors; and a resistor having one terminal connected to the other terminal of the fourth MOS transistor and the other terminal connected to the gates of the third and fourth MOS transistors, the second reference current being supplied to the other terminal of the third MOS transistor, the first reference current being supplied through the other terminal of the resistor.

12. The apparatus as recited in claim 11, wherein the current supplying unit includes a fifth MOS transistor having one terminal connected to the power supply terminal, a gate connected to the gate of the second MOS transistor, and the other terminal outputting the supply current to the diode.

13. The apparatus as recited in claim 12, wherein the unit for adjusting the amount of the supply current includes:

a sixth MOS transistor having one terminal connected to the power supply terminal and a gate receiving a first selection signal of the selection signals;

a seventh MOS transistor configured to connect the other terminal of the sixth MOS transistor and the other terminal of the fifth MOS transistor, a gate of the seventh MOS transistor being connected to the gate of the fifth MOS transistor;

an eighth MOS transistor having one terminal connected to the power supply terminal and a gate receiving a second selection signal of the selection signals; and a ninth MOS transistor configured to connect the other terminal of the eighth MOS transistor and the other terminal of the fifth MOS transistor, a gate of the ninth MOS transistor being connected to the gate of the fifth MOS transistor.

14. The apparatus as recited in claim 13, wherein a current ratio transferred through the first MOS transistor, the second MOS transistor, and the fifth MOS transistor of the temperature-compensated current generating part is 1/3:1:1/4.

* * * * *